US007814710B2

(12) United States Patent
Foglia

(10) Patent No.: US 7,814,710 B2
(45) Date of Patent: Oct. 19, 2010

(54) ROOF ANCHORING SYSTEM

(76) Inventor: Silvino R. Foglia, 105 Banyan Cir., Jupiter, FL (US) 33458

( * ) Notice: Subject to any disclaimer, the term of this patent is extended or adjusted under 35 U.S.C. 154(b) by 1228 days.

(21) Appl. No.: 11/340,219

(22) Filed: Jan. 26, 2006

(65) Prior Publication Data

US 2007/0180780 A1 Aug. 9, 2007

(51) Int. Cl.
*E04B 7/04* (2006.01)

(52) U.S. Cl. ..... 52/92.2; 52/709; 52/92.3; 52/93.1; 52/710; 52/711

(58) Field of Classification Search ..... 52/709, 52/92.2, 92.3, 93.1, 710, 711, 283, 714, 708, 52/745.21, 295, 698
See application file for complete search history.

(56) References Cited

U.S. PATENT DOCUMENTS 1,115,243 A 10/1914 Reid
1,155,243 A * 9/1915 Jordahl ..... 52/710
1,588,628 A 6/1926 Sellers
1,657,441 A 1/1928 Huovinen
1,708,091 A 4/1929 Healy
1,929,835 A 10/1933 Awbrey
1,988,124 A * 1/1935 Johnson ..... 52/710
2,396,826 A 3/1946 Callan
2,396,828 A 3/1946 Carpenter
2,947,119 A 8/1960 Puckett, Jr.
3,000,145 A 9/1961 Fine
3,005,292 A * 10/1961 Reiland ..... 52/99
3,565,385 A * 2/1971 Zurawski ..... 248/343
3,601,347 A 8/1971 Attwood et al.
3,727,355 A 4/1973 Vachon
3,994,111 A 11/1976 Papayoti
4,014,151 A 3/1977 Erhart
4,052,833 A * 10/1977 Beine ..... 52/710
4,085,556 A 4/1978 Sonneville
4,130,977 A 12/1978 Taylor, Jr. et al.
4,365,744 A 12/1982 Moehren
4,569,167 A 2/1986 Staples
4,603,527 A * 8/1986 Vercelletto ..... 52/410
4,606,163 A * 8/1986 Catani ..... 52/434
4,733,986 A 3/1988 Kenning et al.
4,819,390 A 4/1989 Capper
4,826,078 A 5/1989 Arvin et al.
4,946,099 A 8/1990 Bratchell
4,961,553 A * 10/1990 Todd ..... 248/62
5,002,436 A 3/1991 Sigourney
5,083,706 A 1/1992 Bratchell
5,165,628 A 11/1992 Todd et al.
5,335,470 A 8/1994 Alvarez
5,357,721 A 10/1994 Alvarez
5,370,577 A 12/1994 Jonett et al.
5,442,887 A 8/1995 Welsh (Continued)

*Primary Examiner*—Richard E Chilcot, Jr.
*Assistant Examiner*—Mark R Wendell
(74) *Attorney, Agent, or Firm*—McHale & Slavin, P.A.

(57) ABSTRACT

The instant invention relates to an infinitely adjustable anchoring system for attaching structural members to a support member. The system comprises a continuous, elongated, removable retaining track secured to the outer surface of a support member and configured to receive at least one adjustable connector plate therein. The adjustable connector plates are capable of attaching to structural members having various dimensions and pitches relative to the track. The invention includes a reusable centering bracket assembly used to install a retaining track assembly along an upper portion of a support member.

15 Claims, 13 Drawing Sheets

U.S. PATENT DOCUMENTS

| | | | | | |
|---|---|---|---|---|---|
| 5,467,569 | A | | 11/1995 | Chiodo | |
| 5,548,939 | A | | 8/1996 | Carmical | |
| 5,640,822 | A | | 6/1997 | Haswell | |
| 5,699,639 | A | * | 12/1997 | Fernandez | 52/707 |
| 5,732,524 | A | | 3/1998 | Kalker, Jr. et al. | |
| 5,743,062 | A | * | 4/1998 | Fricker | 52/704 |
| 5,799,907 | A | * | 9/1998 | Andronica | 248/62 |
| 5,823,727 | A | | 10/1998 | Lee | |
| 6,073,404 | A | | 6/2000 | Norfleet | |
| 6,334,285 | B1 | | 1/2002 | Kirschner | |
| 6,341,466 | B1 | | 1/2002 | Kehoe et al. | |
| 6,598,363 | B1 | | 7/2003 | Fergusen et al. | |
| 6,609,344 | B2 | | 8/2003 | Saldana | |
| 6,662,517 | B1 | | 12/2003 | Thompson | |
| 7,469,511 | B2 | * | 12/2008 | Wobber | 52/474 |
| 2003/0217521 | A1 | | 11/2003 | Richardson et al. | |
| 2007/0039281 | A1 | * | 2/2007 | Zambelli et al. | 52/710 |

* cited by examiner

FRONT VIEW

SIDE VIEW

SIDE VIEW

TOP VIEW

ROOF ANCHORING SYSTEM

FIELD OF THE INVENTION

This invention relates to a system for the securement of structural building members; particularly a removable anchoring system for use in masonry, frame and other types of construction; more particularly an infinitely adjustable anchorage system capable of attaching structural members of various dimensions and pitches to the outer surface of a support member.

BACKGROUND OF THE INVENTION

In certain areas of the world prone to extreme weather conditions, such as hurricanes, typhoons, earthquakes, tornadoes, etc., contractors are often required to adhere to strict regional building codes established to ensure buildings are constructed to withstand these intense conditions.

The roof of a building is the uppermost structural assembly and particularly vulnerable to these adverse conditions, (e.g., high wind shear generated during a hurricane or tornado). The roof is supported by exterior and/or interior support walls and can have many shapes and geometries; the most common roof structures consist of trusses or rafters, or I-beams made of wood, steel, etc. During high wind shear, the roof can act like a low efficiency wind foil creating vertical uplift or lateral thrust forces on the windward and leeward side of the roof. These forces can create stress that may lift off the top of the building. If the roof fails, these winds can enter the building causing greater destruction.

The manner in which the structural members (e.g., trusses, rafters, beams, joists) are connected to the support members (e.g., walls) of a building has received much regulation as these areas are the most likely to fail during the application of loads other than gravitational, such as uplift or lateral thrust forces. When properly secured together the loads experienced by the structural members distribute the upward lift and lateral thrust along the support member to the foundation. Thus, these loads are countervailed by the overall weight of the building.

In masonry construction, a key structural element of the support wall is the tie-beam or bond-beam, often fortified internally with reinforcement bars. The tie-beam, bond-beam, or other support structure is located at the top of the wall and used to attach the structural members. The beam can either be poured concrete (i.e., U-shaped concrete or forms filled with concrete) or pre-constructed masonry bond beams.

In wood-frame construction, the support walls are usually framed with 2"×4", 2"×6", or 2"×8" or other structural-grade lumber or materials. The support walls consist of a sole plate located at the bottom, studs (typically spaced at 16" on center), and a double top plate on which the structural members are mounted.

Numerous anchoring devices have been designed for securing structural members to the various support members, some of which include: angles, straps, holdowns, pre-deflected holdowns, tension ties coiled strapping, rafter ties, truss anchors, truss straps, strap truss tie down, masonry uplift connectors, girder tie down, uplift girder ties, wind/seismic anchors. The appropriate anchoring system depends upon the type of construction (wood, masonry, metal, etc.), type of roof (truss, rafter, girder or other).

Each of these aforementioned anchoring systems have their own fastening features, that is, different sizes of nails, screws, bolts, slant nailing via dimple nail holes, diamond holes, speed prongs, slot holes, and other special hardware.

The licensed professional engineer must perform load and stress analysis at each point where the structural member and support member meet (i.e., bearing point), this requires the specification of beams sizes, reinforcement and anchor system used, type and number of fasteners used, etc. This process is time consuming and creates increased costs and delays in building construction.

In masonry construction, when the tie-beams are cast, a portion of the anchoring device is placed within the wet concrete. Next, the structural members are mounted onto the tie-beams. One problem that frequently occurs is that the structural members (e.g., truss/rafter) end up positioned away from where the anchoring devices are permanently attached to the concrete. In such instances, different anchors designed for retrofit applications must be installed in juxtaposed relation to each structural member. This retrofit process requires drilling into the tie-beam after the concrete has adequately hardened for placement of wedge bolts or threaded rods that will need to be epoxied in place and subsequently undergo a curing period before fastening the anchors to the structural members, thereby, possibly delaying construction and increasing cost.

Wood structural members present an additional problem as these anchors are often fastened to structural members using nails that can cause the wood to split since most of these members are made of southern pine lumber, which has a high strength but tends to split easily. This can undermine the integrity and strength of the structural member.

What has been heretofore lacking in the art is a universal, removable anchoring system of (1) adequate strength for utilization in all types of construction (masonry, metal, wood, etc.) using standard hardware (bolts, nuts, etc.), (2) having infinite adjustability whereby location of the structural members prior to installation is not needed, and (3) designed for maximum strength under load in a surface-mounted orientation.

RELATED PRIOR ART

The prior art provides various anchoring assemblies for securing structural members to masonry support members. Although some of these systems provide some limited adjustment of the anchor with respect to the structural member, these anchoring systems require additional components for installation making them expensive and difficult to use.

For example, U.S. Patent Application Publication No. 2003/0217521 to Richardson et al., discloses an anchor system for attaching a series of structural members to a wall comprising an elongate horizontal track and a plurality of anchor plates. The horizontal track has a pair of inwardly spaced apart sidewalls defining therebetween an upwardly facing channel with a restricted opening. Each anchor plate includes an enlarged head portion, nailing plate and a relatively narrow strap extending between the head portion and the nailing plate. The strap is sized to pass between the sidewalls to position the nailing plate normal to the track for attaching a structural member thereto. The head portion is sized to fit within the channel and engage the inwardly angled sidewalls to retain the anchor plates at selected longitudinal positions.

Unlike the instant invention, when used in masonry applications, the track of the aforementioned anchor system must be completely embedded within the concrete to resist the tendency of the track to experience outward deflection of the inwardly angled sidewalls which are primarily relied upon for engaging the head portion during the application of uplift loads.

In the instantly disclosed invention, the rectangular configuration of the channel is such that the anchor plate acts primarily against the flanges upon application of uplift forces on the structural members and not the sidewalls, thus permitting the track to be installed to the outer surface of the support member, rather than necessitating its being embedded within the concrete. This configuration is particularly advantageous should the track need to be replaced.

In the aforementioned reference, the mason must push the track into the freshly poured concrete; this can result in a track which is not level with the outer surface of the support member or introduce concrete into the track that must be removed prior to use. Otherwise, the track is placed within the lintel blocks and concrete poured around it. This latter process requires that the track first be capped by an additional covering means to prevent concrete from entering the track which could interfere with positioning the anchor plate along the track. Attempting to fill the concrete around the track could also result in a discontinuous concentrations of concrete around the embedded track with pockets of air undermining the strength of the cured concrete. The structure of Richardson prevents use above a support beam since Richardson fails to provide a bearing surface for structural members such as wood trusses. Further, the structure of Richardson requires a moisture, or vapor, barrier between the concrete and any wood structural member. In addition, Richardson's use of an embedded track severely reduces the strength of the assembly by reducing the amount of concrete that can be inserted, concealing the concerned area of concrete placement, all of which causes the moment capacity to be weaker. Further, there is no room for stirrups.

Moreover, as is contemplated by Richardson et al., floating or uplifting of the track within the wet concrete may occur and should be prevented by placing a series of bricks periodically along the length of the track. Again, this can result in a situation where the track is not level within the concrete or present a potentially dangerous work site as these loose bricks must remain positioned along the support wall during the curing process.

The simple design of the anchor system of the instant invention does not require additional devices to prevent cement from seeping into the track or weights to prevent the track from floating. The anchoring system of the present invention can be removed and replaced as needed. Moreover, unlike the invention to Richardson et al., the rectangular channel of the track of the present invention provides maximum surface area contact between the rectangular anchor plate and the track, thus, does not require inwardly disposed sidewalls or sidewalls with additional downwardly extending lips or recesses designed to engage the anchor plate. The anchor plate of the present invention is capable of complete angular disposition inside the channel such that it is capable of securing to the structural member independent of the angle relative to track.

U.S. Pat. No. 5,699,639 to Fernandez and U.S. Pat. Nos. 5,357,721 and 5,335,470, both to Alvarez disclose an adjustable anchorage device for keeping a truss in place with respect to a poured concrete body having an elongated housing fully embedded within the concrete. The housing includes a longitudinal slot configured to receive a connecting plate slide therein for trusses to be adjusted. However, the range of adjustment is limited to the length of the longitudinal slot which can be of little help in instances when the trusses do not meet up with the longitudinal slot. Furthermore, the longitudinal slot must be capped during the concrete pour to prevent cement from entering the slot. The references to Alvarez disclose detachable arms mounted to the housing level within the concrete. These prior art references fail to disclose adjustable arms capable of centering the housing along walls of various widths.

The instant invention provides a simple anchoring system that overcomes many of the aforementioned disadvantages encountered in the prior art.

SUMMARY OF THE INVENTION

The present invention is directed toward an infinitely adjustable anchoring assembly for attaching at least one structural member to the outer surface of a support member (i.e., wall) to distribute uplift loads and horizontal thrust forces from the structural members along the continuous track to the attached support member.

The assembly includes an elongated retaining track having a substantially rectangular channel with an opening formed therein and at least one anchoring member, each anchoring member constructed and arranged to removably attach the track to the support member.

The assembly further includes at least one adjustable connector plate having an upper portion and lower portion with a neck portion extending therebetween. The upper portion including at least one aperture formed therethrough capable of receiving at least one corresponding attachment means. The neck portion having dimensions approximate to and less than the channel opening of the track. The lower portion of the connector plate having dimensions approximate to and less than the channel such that the connector plate is capable of infinite lateral movement and angular disposition inside the channel, thereby being capable of securing to a structural member independent of the angle or location of the structural member relative to the track.

While the prior art does disclose adjustable anchoring systems, the sidewall design of these tracks and the bottom shape of the anchor plates require the track be completely embedded within the concrete to provide the necessary resistance to the outward deflection of the sidewalls created by uplift loads to the head portion of the anchor plate acting against them. If these prior art tracks were secured to the outside of the support member the bottom portion of the anchor plate would act like a wedge forcing outward deflection of the track sidewalls upon the application of uplift forces. Without additional reinforcement for the track sidewalls, this continuous application of outward force will eventually cause these sidewalls to fail, increasing the potential for disastrous consequences. The devices disclosed in previously issued patents fail to address the need for a bearing load area when a support is placed over a beam. Further, the devices disclosed in the previously issued patents require vapor barrier between the concrete beam and structural member to prevent wood rot.

In the instant invention, the rectangular configuration of the channel and the correspondingly shaped bottom of the connector plate is such that the connector plate acts against the flanges upon application of uplift forces on the structural members and not the sidewalls, thereby permitting installation of the track to the outer surface of the support member and not embedded within the concrete. This configuration is particularly advantageous should the track need to be replaced. Moreover, because the track is capable of being installed to the outer surface of a freshly poured masonry support member there is no need for additional devices to prevent cement from entering the track or weights to prevent the track from floating during installation. The track of the instant invention preferably includes pre-attachment of anchoring members to the track, such as j-bolts, allowing the track to be placed on freshly poured concrete with the anchoring members attached. In the case of masonry construction, the sections of track may be set in place after the concrete is poured and before the concrete begins to set. This eliminates any space problems in pouring the concrete and also prevents the possibility of pouring concrete in the track accidentally.

Accordingly, it is an objective of the instant invention to provide a surface mounted adjustable anchoring assembly which is resistant to outward deflection caused by uplift forces comprising a removable elongated track for use in both masonry and frame applications in which there is no need to locate the structural members prior to installation of the track in combination with at least one connector plate and at least one anchoring member.

Another objective of the present invention is to provide an elongated track for use in masonry applications in which concrete does not have an opportunity to enter the track and interfere with the positioning of the connector plate along the track.

Still another objective of the present invention is to provide an elongated track that provides a proper bearing area for trusses, rafters and other structural members.

Still another objective of the present invention is to provide a continuous track which allows for ease of truss settings.

It is yet another objective of the instant invention to provide an assembly that is economical to manufacture in that it has few components or complicated moving parts.

It is a further objective of the instant invention to provide an assembly that can be used to fasten all the various types of structural members (e.g., roofs, floor joists, or the like) to all masonry and frame (e.g., wood, steel, etc.) support members, thereby providing a universal anchoring system in which no special hardware is needed and reducing load and stress analysis needed.

It is a still further objective of the invention to provide an elongated track system in which connector plates may be positioned along each side of the structural member for improved resistance to uplift and lateral forces.

Yet another objective of the instant invention is to provide a system which uses standard fastening means found in the construction industry.

Still another objective of the present invention is to provide a longitudinal and/or lateral clamping means to further reinforce the anchoring assembly from uplift and lateral forces, respectively.

A further objective of the present invention is to provide a connector plate capable of angular disposition and infinite lateral translation with respect to the channel such that the upper portion is capable of securing to the structural member independent of its angle relative to the lateral axis of the track; this is especially advantageous for anchoring a hip truss/rafters.

An additional objective of the present invention is to teach a connector plate constructed and arranged for attaching to at least one structural member, such as, trusses, rafters, roof joists, floor joists, beams or the like.

Another objective of the present invention is to provide a reusable centering bracket assembly and method for quickly and easily installing an elongated retaining track along the center of a support member (i.e., wall).

Still another objective of the instant invention is to provide a reusable centering bracket capable of centering the elongated track along support members of various widths.

Another objective of the instant invention is to provide a sufficient bearing area for structural members such as trusses, rafters and the like to prevent damage thereto.

Another objective of the instant invention is to size a retaining track that operates as a moisture (vapor) barrier between wood structural members such as trusses, rafters, joists and the like, and a masonry wall such as a beam, lintel or the like.

Yet still another objective of the instant invention is to provide a system for use in masonry construction that by use of a retaining track does not interfere with the placement of reinforcing steel re-bars, stirrups and the like by placement of the retaining track on the surface of the wall, beam, or lintel.

Yet still another objective of the instant invention is to maintain the strength of the beam, tie, bond, lintel or other support by placement of a retaining track on the surface of the support.

Another objective of the instant invention is to provide a system that can be used of any type of construction, including prefabricated walls which emphasizes the difference of the instant invention to the prior art with is restricted to use with masonry construction.

Still another objective of the instant invention is to provide a track system for masonry construction that can be set in place after the concrete is poured and before the concrete begins to set. Placement of the track and anchors after the concrete has been poured eliminates the possibility of pouring concrete in the track and assures proper orientation.

Yet another objective of the instant invention is to teach a reusable centering bracket for use in masonry application that can be used to embed at least a portion of the track within the freshly poured support member.

A further objective of the instant invention is to teach a reusable centering bracket for use in masonry applications, without reduction of the cross section, designed to preclude the track from penetrating the outer surface of the support member.

Other objectives and advantages of this invention will become apparent from the following description taken in conjunction with any accompanying drawings wherein are set forth, by way of illustration and example, certain embodiments of this invention. Any drawings contained herein constitute a part of this specification and include exemplary embodiments of the present invention and illustrate various objects and features thereof.

DETAILED DESCRIPTION OF THE INVENTION

Detailed embodiments of the instant invention are disclosed herein, however, it is to be understood that the disclosed embodiments are merely exemplary of the invention, which may be embodied in various forms. Therefore, specific functional and structural details disclosed herein are not to be interpreted as limiting, but merely as a basis for the claims and as a representative basis for teaching one skilled in the art to various employ the present invention in virtually any appropriately detailed structure.

Figure 1:
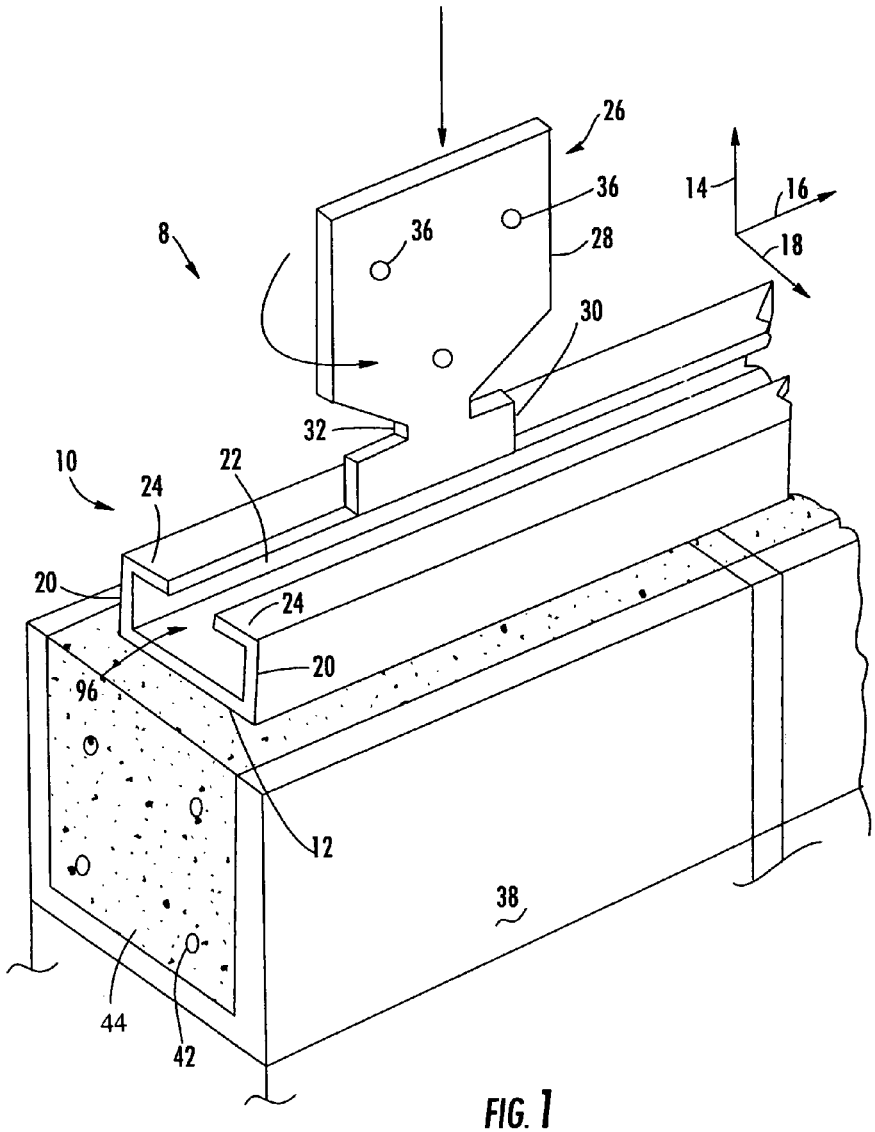
FIG. 1 illustrates an adjustable anchoring assembly according to a preferred embodiment of the instant invention, used to secure structural members to the outer surface of a masonry support wall.

Referring now to FIGS. 1-6, wherein like elements are numbered consistently throughout, FIG. 1 illustrates an infinitely adjustable anchoring assembly used to secure structural members having various dimensions and pitches to the outer surface of a support member (e.g., wall) according to a preferred embodiment of the instant invention, the assembly being generally referenced as 8.

The anchoring assembly comprises an elongated retaining track system 10 removably attached to a support wall 38. The support wall is shown here as a tie beam filled with cementitious material 44 fortified internally with reinforcement bars 42. The track system is constructed and arranged to receive a plurality of adjustable connector plates 26 (only one shown) for use in the anchoring assembly of the present invention.

The track system 10 is illustrated herein as having a base member 12. The base member is integrally connected to a pair of oppositely spaced sidewall members 20, shown extending substantially perpendicular from the base member along the longitudinal axis 14. The base member includes (or may be modified to include) a plurality of apertures 45 formed therein (only one shown in FIG. 2), each constructed and arranged to receive an anchoring member 34, as discussed below. In a preferred embodiment, these apertures 45 are spaced at 16" and 24" on center (or other) to minimize the possibility of aligning with the structural members (e.g., trusses, rafters, roof joists, floor joists, beams or the like.) The anchoring members and base may be manufactured with the anchoring members integrally attached to the base member, otherwise, the anchoring members may be attached to the base member at the job site. The flange members 24 are sized to provide a moisture, or vapor, barrier between wood structural members and masonry.

Figure 6:
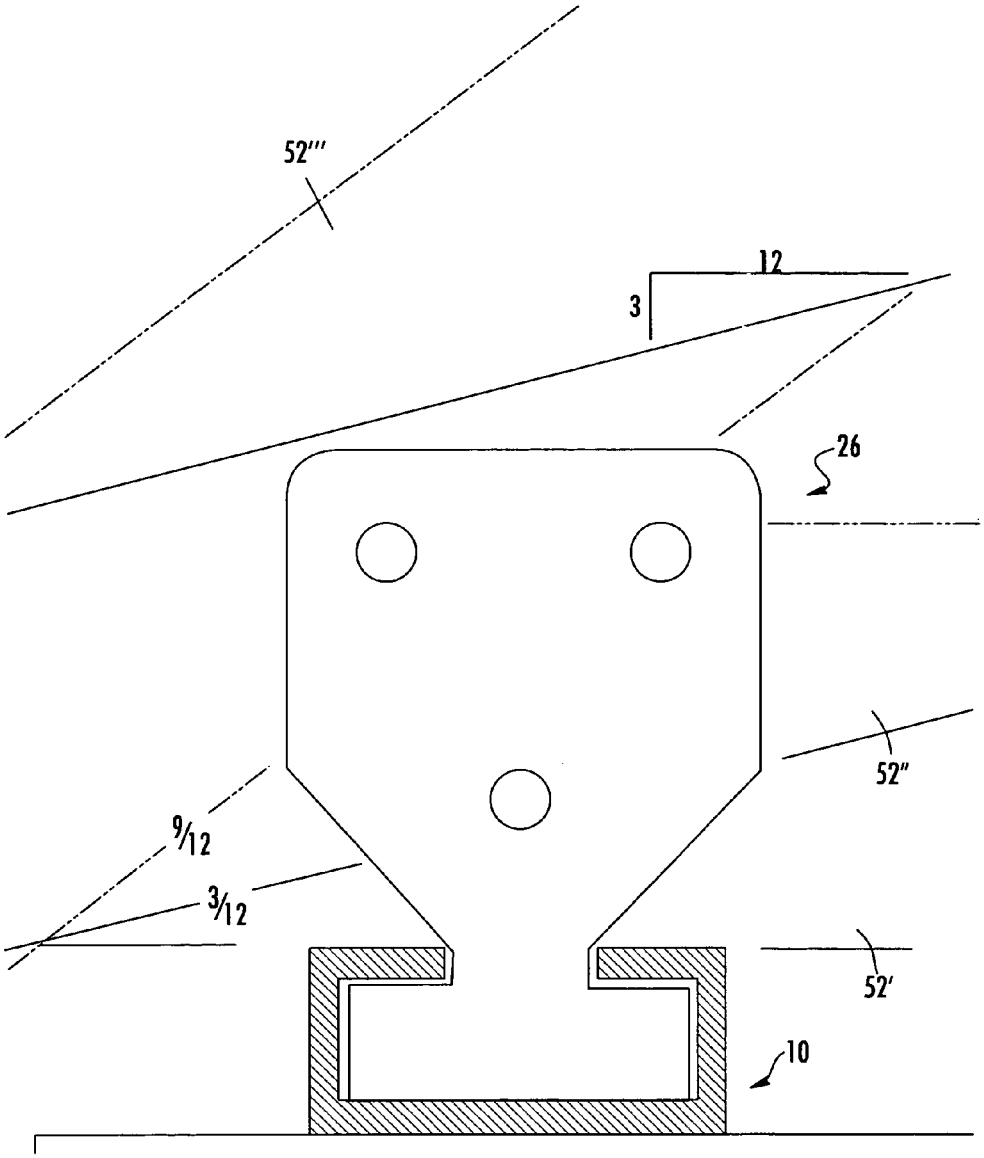
FIG. 6 illustrates a cross-sectional view of the instant assembly, as seen along the lateral axis, wherein the connector plate is capable of fastening to structural members constructed at virtually any pitch.

Each sidewall member 20 of the track assembly 10 has an inwardly extending flange member 24 located substantially parallel to the base member 12, thereby defining a generally rectangular channel 96 with an opening 22 formed between the flange members. The flange members are of sufficient dimension to permit infinite angular disposition of the lower portion of the anchor plate within the channel while providing maximum surface area contact between the rectangular lower portion of the anchor plate and the inner surface of the flange members 24 without the need for additional material (FIG. 6). The flange members 24 are sized to provide sufficient bearing area for trusses, rafters, and the like structural members to sit on.

The track system may be constructed from any durable material known in the art including, albeit not limited to, galvanized steel, stainless steel, or the like.

The adjustable connector plate 26 has an upper portion 28 and lower portion 30 with a neck portion 32 extending therebetween. During use, each connector member is placed within the track by orientating the plate parallel to the lateral axis 16 of the track and inserting the lower portion through the opening 22 and into channel 96. Next, the plate is rotated about the longitudinal axis 14 within the channel such that the upper portion is normal relative to the track. The plates can then be positioned at any location along the track.

Figure 5:
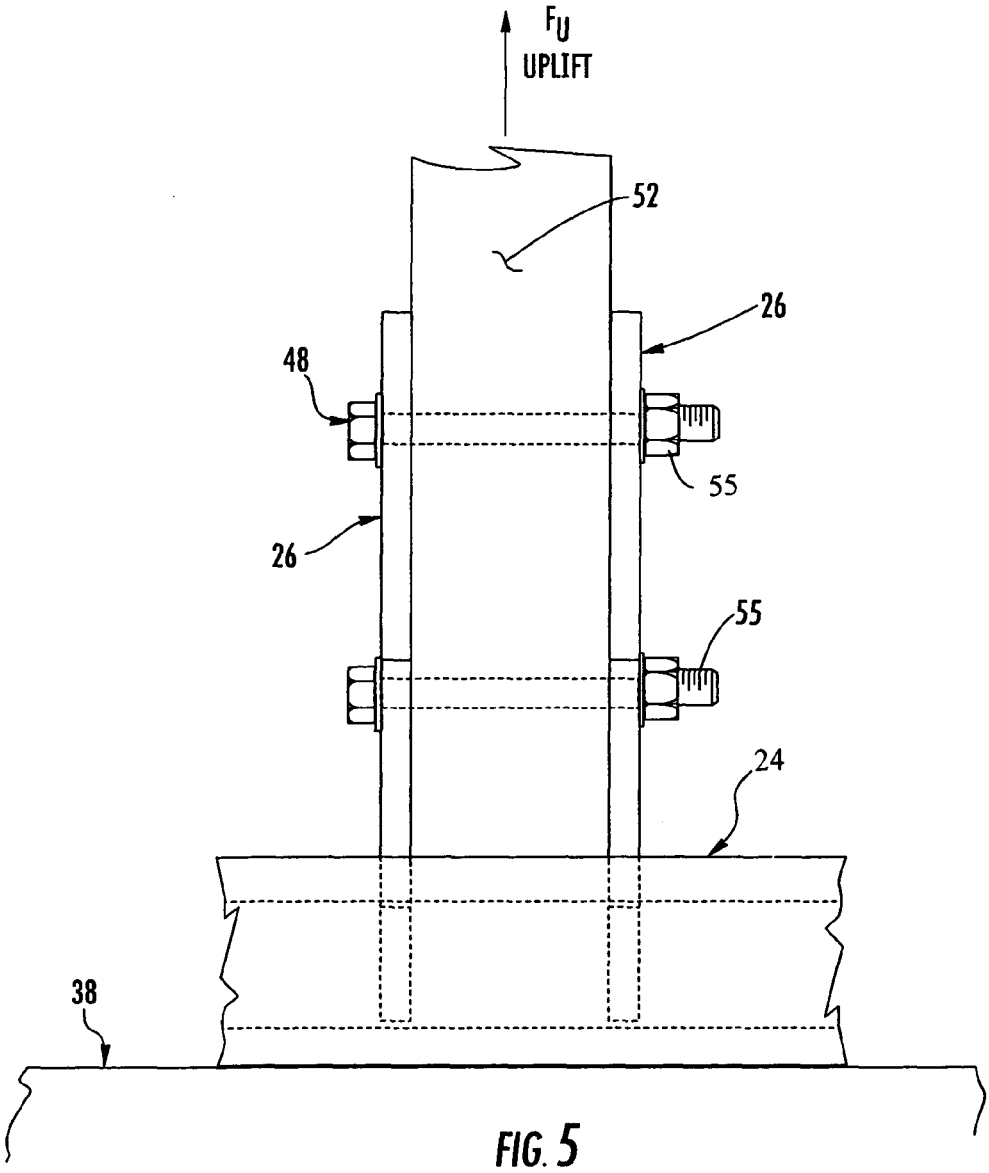
FIG. 5 illustrates a cross-sectional view of the instant assembly, as seen along the width axis, wherein the structural member is sandwiched by two connector plates with bolts.

As shown herein, the upper portion of the plate includes at least one aperture 36 formed therethrough and capable of receiving at least one corresponding attachment means (e.g. bolts, screws, nails, or other fasteners) to secure to a structural member (FIGS. 5, 6). The neck portion 32 has dimensions approximate to and less than the channel opening 22 and the lower portion being generally rectangular and having dimensions approximate to and less than the generally rectangular channel 96, wherein the connector plate can translate along the lateral axis 16 of the track when inside the channel. The angular rotation of the lower portion within the channel allows the upper portion to secure to the surface of a structural member independent of the angle or location of the structural member relative to the lateral axis 16 of the track.

Figure 10:
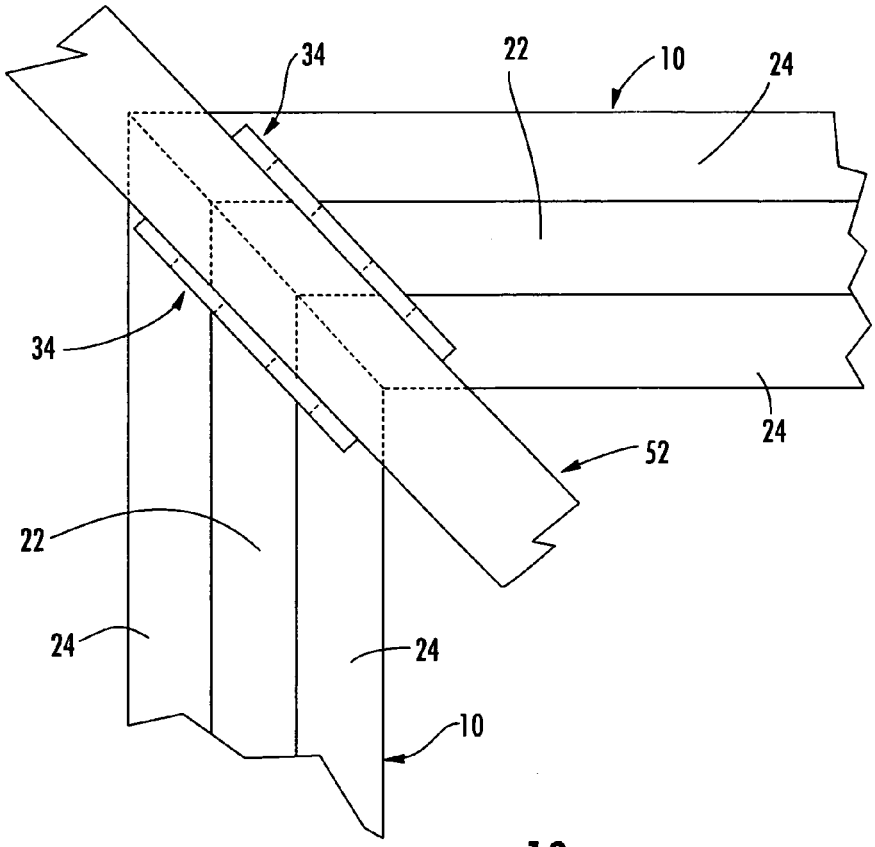
FIG. 10 illustrates an elevated view of the anchoring system of the instant invention used in a hip-roof structure.

For example, as shown in FIG. 10, the instant anchoring system can be used in a hip-roof structure in which a hip structural member 52 is anchored at the corner created by two support members of a building structure. The track 10 can be cut to corresponding angles (miter) to create the desired turn and can be spliced together by any method known to the skilled artisan (e.g., welding, adhesives, etc.), thereby forming a continuous track at a miter joint without the need of an additional track splice. However, proper placement of the anchoring members eliminates any need for splicing. Thus, the rectangular lower portion 30 of the connector plate 26 can translate across the joint without having to be disengaged from the channel, which heretofore has not been possible.

Figure 2:
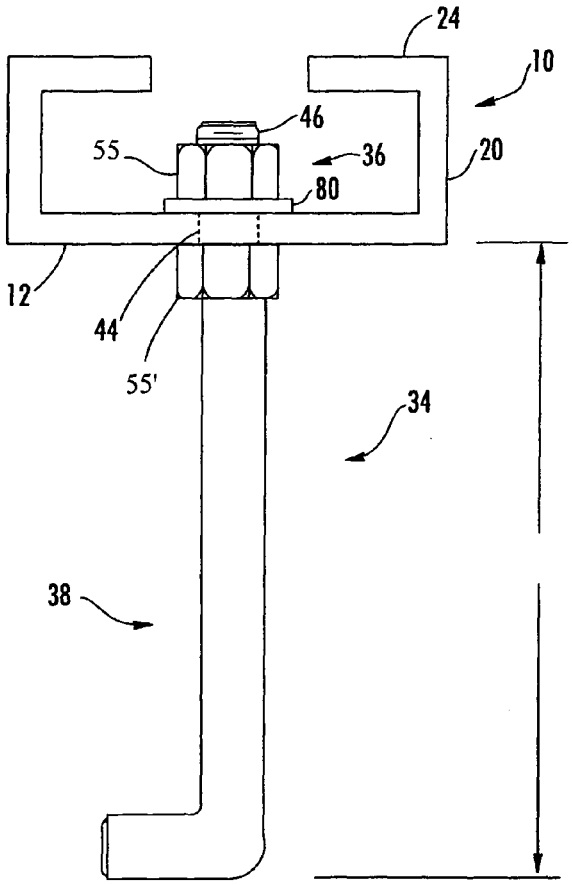
FIG. 2 illustrates a cross-sectional view of the track, as seen along the lateral axis, wherein the base member is constructed and arranged to receive an anchoring member.
Figure 3:
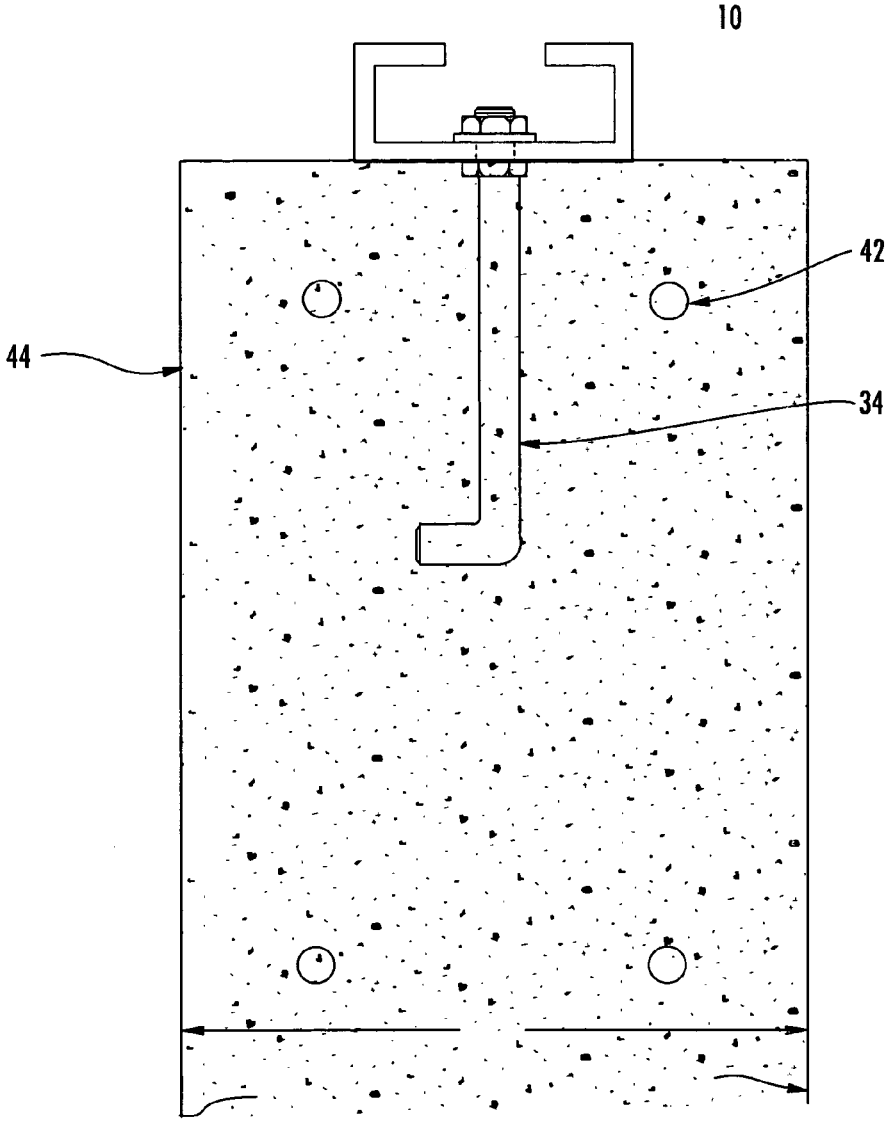
FIG. 3 illustrates a cross-sectional view of the track member, as seen along the lateral axis, removably attached to the anchoring member secured to a masonry-type support member.

FIG. 2 illustrates a side view of one embodiment of an anchoring member 34 integrally attached to the track system of the instant invention. The anchoring member includes a first end 36 constructed and arranged to removably attach to the base member 12 of the track system 10 and a second end 38 adapted to secure to the outer surface of the support wall, without necessitating that the track be embedded within the outer surface.

In a preferred, albeit not limiting embodiment, the anchoring member is a "j-bolt" configured to extend through aperture 44 in the base member and having a plurality of threads 46 located at the first end, wherein the user can attach at least one corresponding sized fastener 48 (e.g. nut and washer 50) to affix the j-bolt to the track.

In masonry applications, the second end 38 of the j-bolt is simply set into wet cementitious material 44 with the base 12 remaining above the cementitious material. The material 44 is allowed to cure such that the second end of the j-bolt remains permanently secured to the support member (see FIG. 3). It is contemplated herein that the second end of the j-bolt could include any shape, configuration, projections, or coating known to enhance retention within the concrete.

Figure 4:
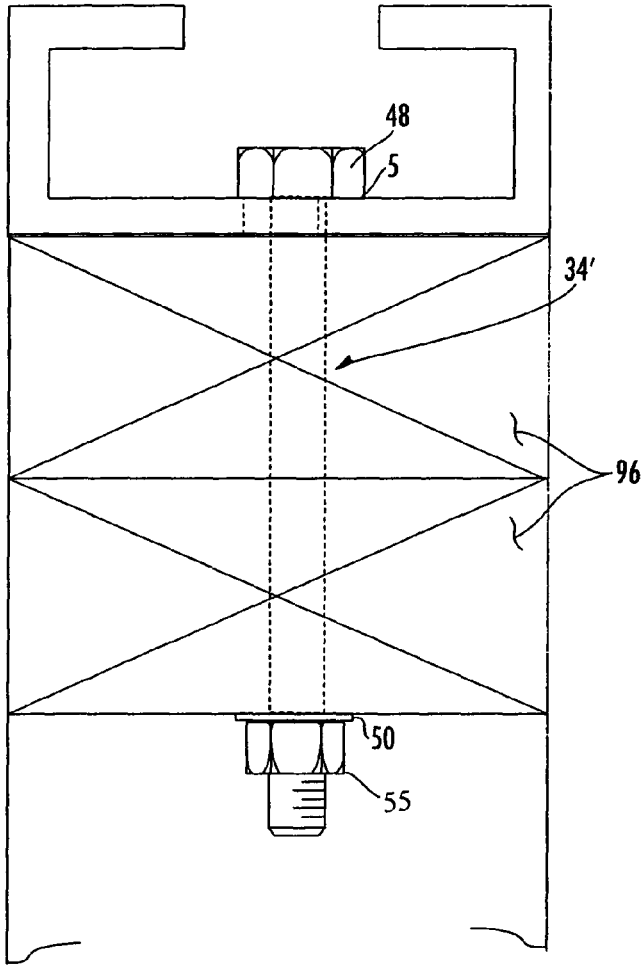
FIG. 4 illustrates a cross-sectional view of the track member, as seen along the lateral axis, removably attached to the anchoring member and secured to a frame-type support member.

Referring now to FIG. 4, the anchoring system can be used in frame-type construction, (e.g., steel, wood, or the like). FIG. 4 illustrates the second end of an anchoring member 34' (i.e., threaded shank) constructed and arranged to penetrate the support wall, shown here as double top plate frame members 96 formed by two 2×4" top plates typically used in wood frame construction. For example, this can be accomplished by placing the anchoring member within an appropriately sized hole formed through the double top plate and removably attaching both ends thereto using corresponding fastening means 48 (e.g. nut and washer).

Otherwise, the anchoring member could be a screw-type with helical threads (not shown) designed to secure directly to the support wall.

FIG. 5, shows a cross-sectional view of the instant assembly, as seen along the axis 18, wherein the structural member is sandwiched by two connector plates. The connector plates are placed inside the track and moved adjacent to each side of the structural member 52. Holes are formed, e.g. drilled, through the structural member at the apertures 36 and the connector plates are secured together using any fastening means deemed appropriate. The use of multiple connector plates provides improved resistance to uplift forces. The fastening means are illustrated as, albeit not limited to, nut 55 and bolt 48 configurations. As these fastening means are standard in the construction industry, no special hardware is needed and the professional engineer need only to perform load and stress analysis on one bearing point.

Referring now to FIG. 6, which shows a cross-sectional view of the instant assembly as seen along the lateral axis 16. The connector plate is constructed and arranged to fasten to at least one structural member, such as, floor joists 52', trusses or rafters 52",52'", roof joists, floor joists (FIG. 11), beams or the like, at virtually any pitch relative to the longitudinal axis 14.

Figure 7A:
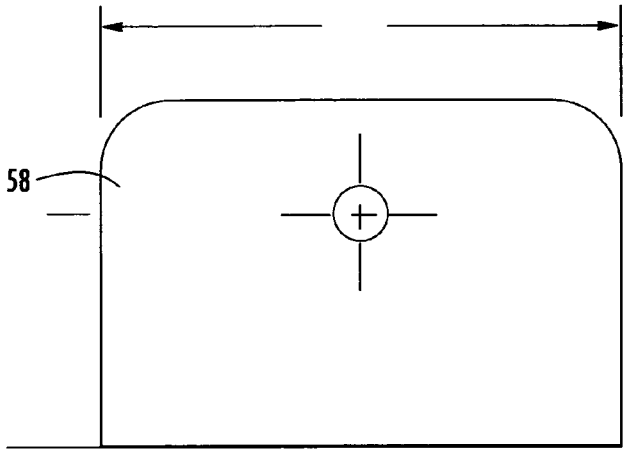
FIG. 7*a* illustrates a front view of one embodiment of a lateral clamping means that can be used in combination with the instant assembly to counteract any lateral motion of the structural member.
Figure 7B:
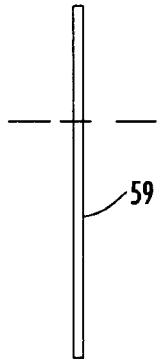
FIG. 7*b* illustrates a side view of the lateral clamping means shown in FIG. 7*a;*
Figure 8:
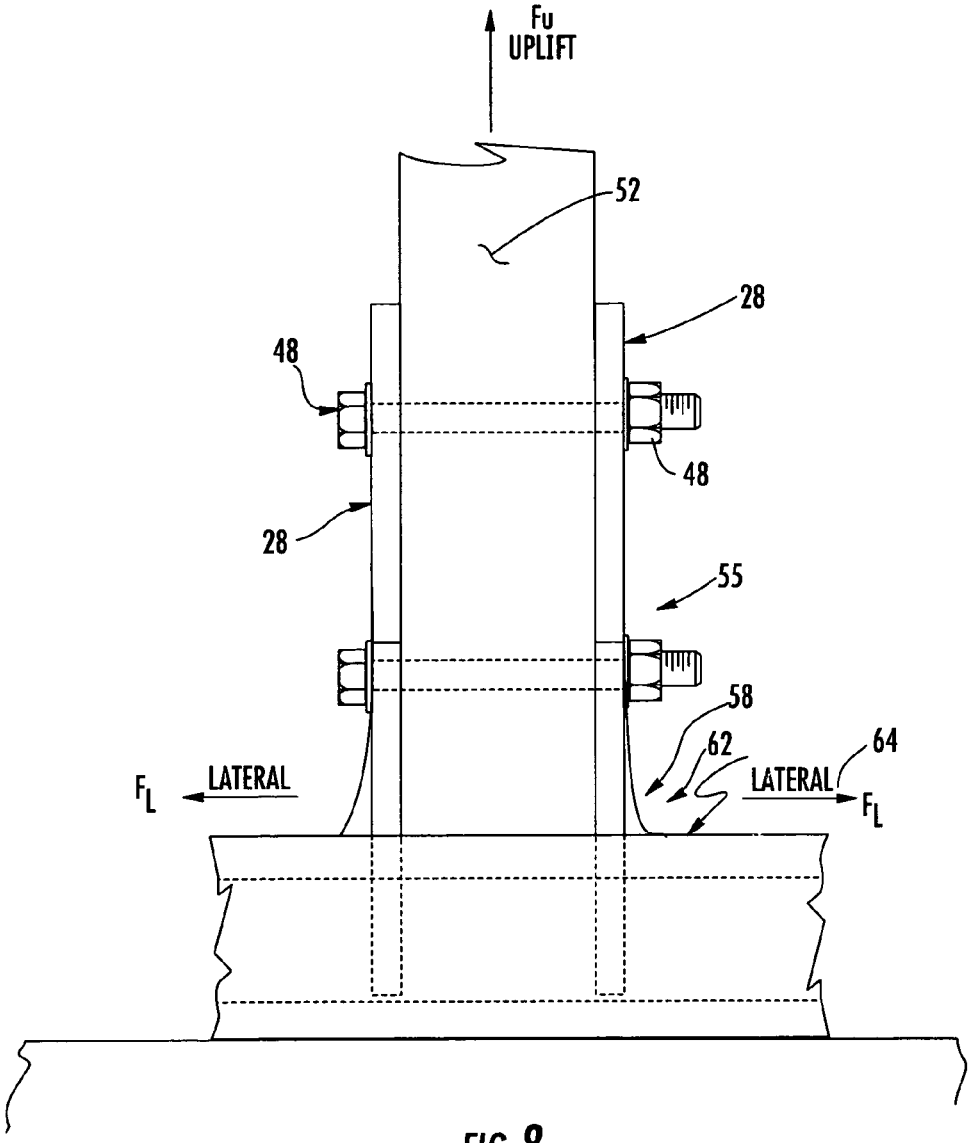
FIG. 8 illustrates a cross-sectional view of the instant assembly, as seen along the lateral axis, with the lateral clamping means of FIGS. 7*a,b* attached to either side of the structural member.

FIG. 7*a-b* illustrate front and side views, respectively, for one embodiment of a lateral clamping means 58 that can be used in combination with the instant assembly. The lateral clamping means 58 can be made from any durable, yet flexible material (e.g., spring-steel). The clamping means has a first end 60 which is integrally connected to the upper portion 34 of a connector plate 26, preferably through the same fastening means used to connect the connector plate to the structural member to reduce the number of fastening means and maintain the integrity of the structural member 52 (FIG. 8). The second end 62 of the clamping means is designed to frictionally engage the track (i.e., flange 24) so that in the presence of lateral loads 64 the frictional forces generated between the second end 62 and the track will countervail actual lateral motion of the structural member. As shown in FIG. 8, a lateral clamping means could be utilized on each side of the structural member.

Figure 9:
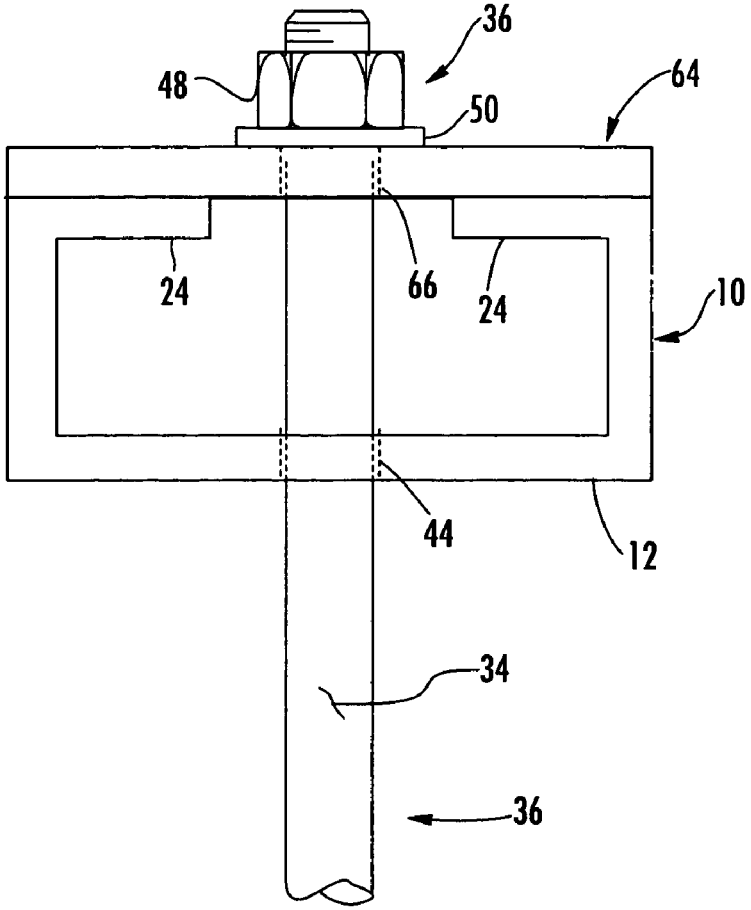
FIG. 9 depicts the cross-sectional view of the track, as seen along the lateral axis, with a longitudinal clamping means in place over the track to further reinforce the anchoring assembly from uplift forces as an alternative way of embodiment of securing the track to a wall.

FIG. 9 illustrates a cross-sectional view of the track seen along axis 16, wherein the adjustable anchoring assembly of the present invention can also include at least one longitudinal clamping means 64 defined by a rigid planar material constructed and arranged for placement over both the inwardly extending flange members 24 to further reinforce track 10 along longitudinal axis 14. The planar material of the longitudinal clamping means having an aperture 66 constructed and arranged to receive the first end 36 of the anchoring member 34, wherein the anchoring means extends through aperture 45 in the base 12 of the track and second end 38 secures to a support wall (e.g., masonry, frame, etc.) As with the embodiment shown in FIG. 2, the anchoring means can have a plurality of threads 46 located at the first end thereof, to which a user can attach at least one corresponding sized fastener 55 (e.g. nut and washer 50) to removably affix the first end of the anchoring means to the longitudinal clamping means. The anchoring means may include a fastener, not shown, along point 35 to lock the member 34 in position during installation. In this example, the fastener located at point 35 may remain embedded in concrete while fastener 55 can be removed to release the track 10. Further, a fastener may also be located at the distal end 37 of the member when the member is placed through wood such as that shown in FIG. 4.

Figure 11:
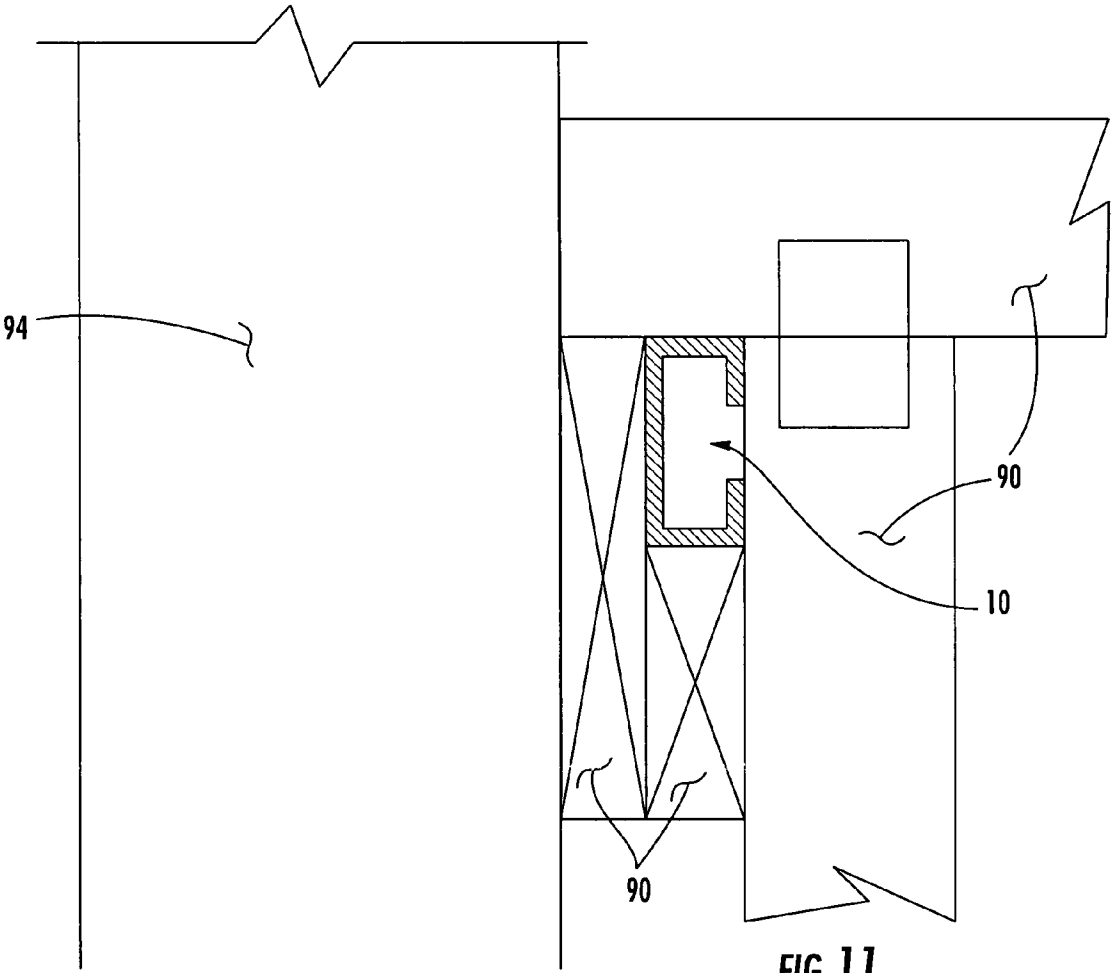
FIG. 11 illustrates an alternative way to secure the anchoring assembly of the present invention to floor joists.

FIG. 11 illustrates one of several possible ways to secure the track 10 to floor truss joists 90 using two ledgers 92 proximate to a masonry-type wall 94. This type of installation would also serve as a longitudinal clamp to the track.

Figure 12A:
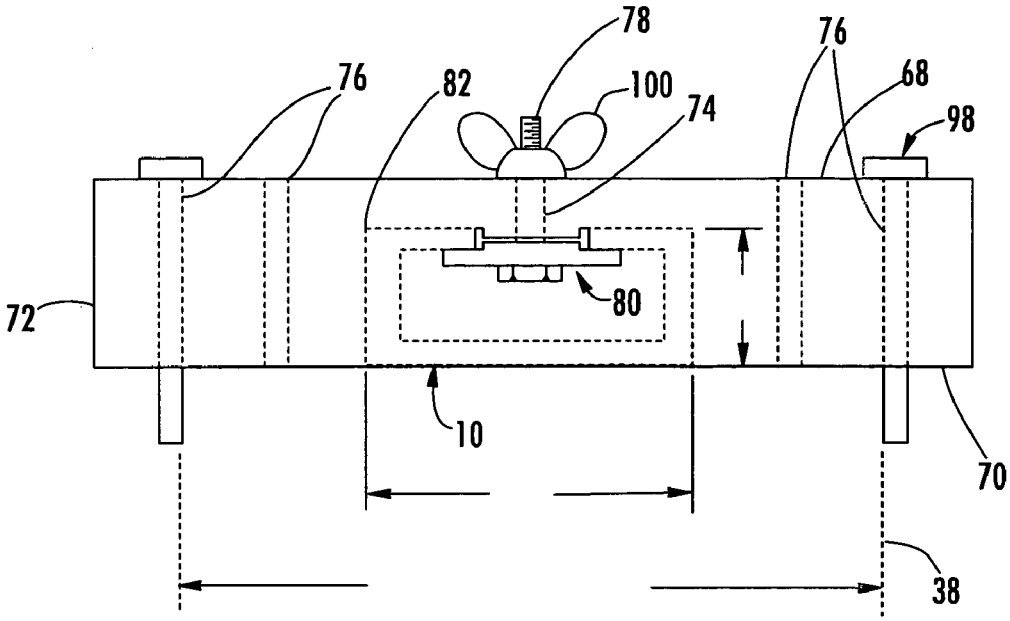
FIG. 12*a* illustrates a side view of a reusable centering bracket assembly for reliably positioning an elongated retaining track along the center of a support member.
Figure 12B:
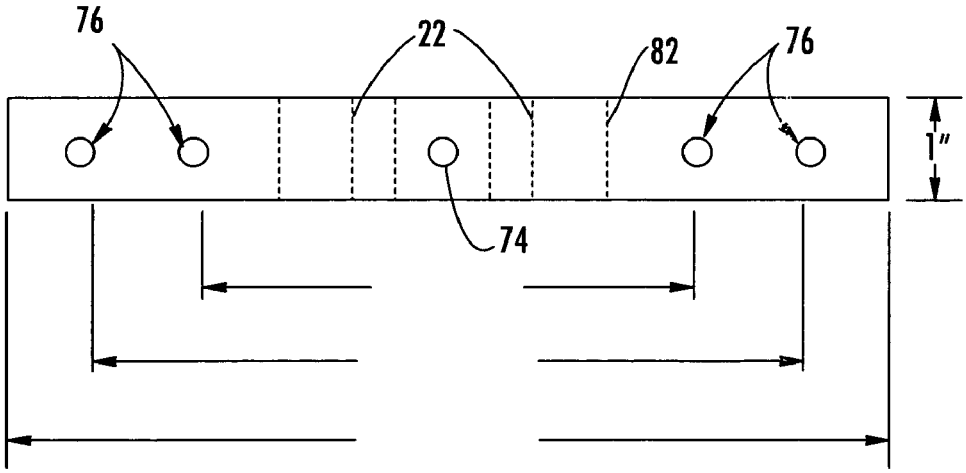
FIG. 12*b* illustrates an elevated view of the reusable centering bracket assembly of FIG. 12*a*.

Referring now to FIGS. 12*a-b*, which illustrate a side and elevated view (as seen along the lateral axis 16) of a reusable centering bracket assembly for reliably positioning an elongated retaining track along the center of an upper portion of a support member (i.e., wall). The assembly comprising a support bracket having first 68 and second 70 planar surfaces and including at least one sidewall 72 extending therebetween. The dimension of the support bracket along the axis 18 is greater than that of the support wall 38. The support bracket has a plurality of apertures, at least one central aperture 74 located at approximately the center thereof and at least one pair of corresponding centering pin holes 76 located at equal distances on either side of the central aperture.

The bracket assembly further comprises a fastening means 78 having a first end with integrally connected head portion 80 sized greater than the channel opening 22 in the track and constructed and arranged to engage the flange members of the track. The second end of the fastening means constructed and arranged to extend through the central aperture and removably attach to the support bracket by any means known in the art (shown here as wing nut 100) such that the track is in juxtaposed relation to the second planar surface.

The assembly includes at least two removable centering pins 98 adapted for placement within corresponding centering pin holes 76 and having sufficient dimensions to extend beyond the second planar surface when placed inside holes 76. The portion extending beyond the second planar surface centering pin is in juxtaposed relation to the sides of the wall when the centering bracket assembly is placed over the support wall. This positions the track at a substantially central location with respect to the width (axis 18) of the support member 38.

Preferably, the distance between the pair of corresponding centering pins should correspond to standard width dimensions of support members (e.g., 5¾", 8", 10"), thus, the assembly is capable of centering the elongated track along support members of various widths.

In addition, the second planar surface of the bracket assembly can include a centralized cutout portion 82 having dimensions substantially corresponding to the elongated retaining track 10 to receive at least a portion of the track therein (see FIG. 12*a*). This allows the track to be positioned centrally with respect to the width (axis 18) of the wall while preventing the track from penetrating the outer surface of the wall when used in recently poured masonry applications.

As discussed above, during use of the reusable centering bracket assembly, the track is secured to the central portion of the bracket by inserting the removable fastening means 78 through central aperture 74 such that the fastening means with integrally connected head portion 80 engages both flange members 24, or opposed sidewalls of the channel. The fastening means is attached to the bracket assembly when the track is in juxtaposed relation to the second planar surface.

A plurality of centering pins 98 are then inserted into the appropriate centering pin holes 76 that correspond to the width of the support member. The elongated track is then positioned along the center of the support member and can be attached thereto by any means appropriate (i.e., anchoring means). The centering bracket is then removed from the elongated track by removing the fastening means and can be reused.

Figure 13:
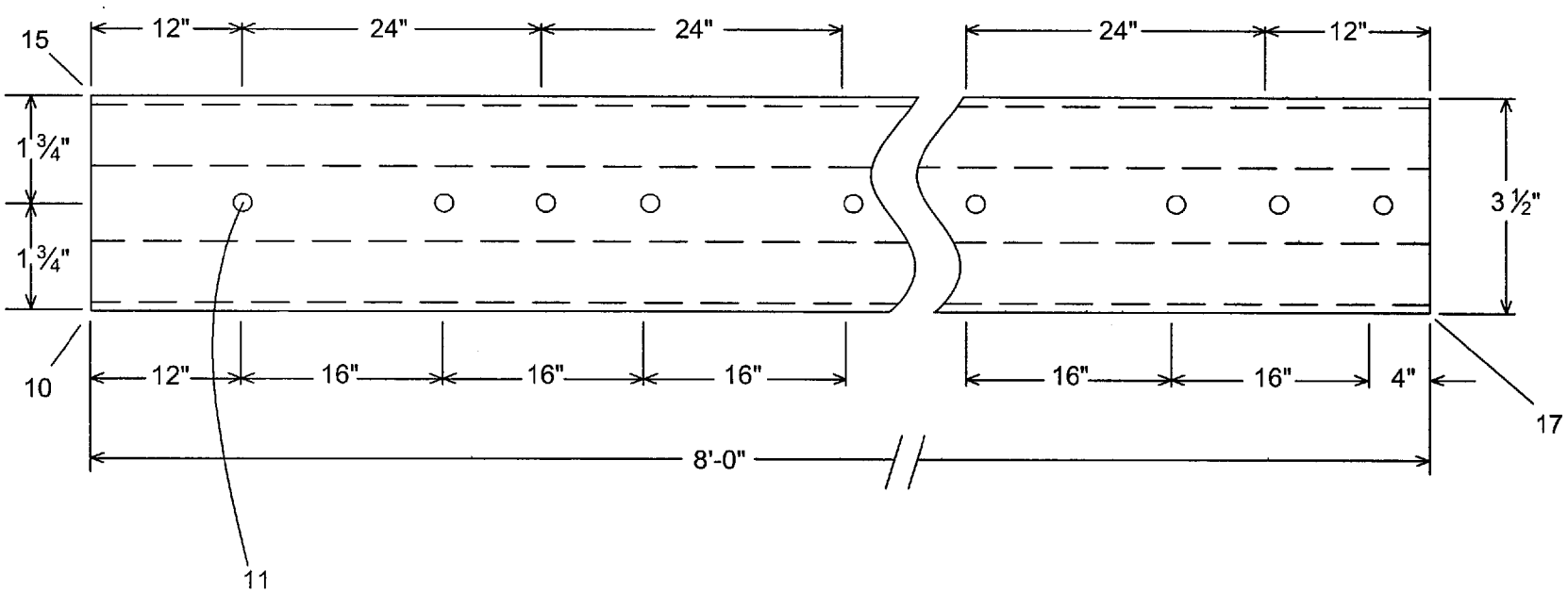
FIG. 13 illustrates a bottom view of a track indicating preferred track hole placement.

FIG. 13 provides an example of hole placement in a track 10 that allows for proper anchoring in a majority of installations to exceed code expectations of the most stringent agencies. In an 8 ft track, hole 11 placement can be arranged for 24 inch positioning with 12 inches from each end, or for 16 inch positioning with 12 inches from the beginning edge 15 of the track and 4 inches at the end edge 17 of the track. In a 3 ½ inch track, the holes are centrally located, 1¾ inches from each side.

All patents and publications mentioned in this specification are indicative of the levels of those skilled in the art to which the invention pertains. All patents and publications are herein incorporated by reference to the same extent as if each individual publication was specifically and individually indicated to be incorporated by reference.

It is to be understood that while a certain form of the invention is illustrated, it is not to be limited to the specific form or arrangement herein described and shown. It will be apparent to those skilled in the art that various changes may be made without departing from the scope of the invention and the invention is not to be considered limited to what is shown and described in the specification and any drawings/figures included herein.

One skilled in the art will readily appreciate that the present invention is well adapted to carry out the objectives and obtain the ends and advantages mentioned, as well as those inherent therein. The embodiments, methods, procedures and techniques described herein are presently representative of the preferred embodiments, are intended to be exemplary and are not intended as limitations on the scope. Changes therein and other uses will occur to those skilled in the art which are encompassed within the spirit of the invention and are defined by the scope of the appended claims. Although the invention has been described in connection with specific preferred embodiments, it should be understood that the invention as claimed should not be unduly limited to such specific embodiments. Indeed, various modifications of the described modes for carrying out the invention which are obvious to those skilled in the art are intended to be within the scope of the following claims.

What is claimed is:

1. An adjustable anchoring assembly for attaching structural members to a wall comprising:

an elongate retaining track removably secured to an upper surface of a wall, said elongate retaining track formed from a horizontal disposed base wall having a first vertical side wall and a second vertical side wall spaced apart and extending upwardly from said base wall, each said side wall including a flange member extending inwardly therefrom in a parallel plane to said base wall defining a substantially rectangular cross section cavity with a restricted opening formed between a distal edge of each said flange member; and at least one connector plate releasably securable to said retaining track, said connector plate defined by a lower portion, an upper portion, and a narrow portion therebetween, said lower portion constructed and arranged to fit within said cavity of said retaining track wherein a lower edge of said lower portion is juxtapositioned to said base of said retaining track, a first and second side edge of said lower portion is juxtapositioned to said first and second vertical side wall of said retaining track, and a first and second upper edge of said lower portion is juxtapositioned to each said flange member of said retaining track, said narrow portion constructed and arranged to fit between the distal edges of said flange members, and said upper portion defines an enlarged nailing plate for securing a structural member thereto;

whereby said retaining track is releasably mounted to an upper surface of the wall and said connecting plate attached thereto whereby uplift forces exerted upon structural members fastened to said connecting plate are isolated to said flange members of said retaining track and weight forces exerted upon the structural members are isolated to said base wall of said retaining track.

2. The adjustable anchoring assembly of claim 1, further including:

at least one anchoring member having a first end and second end, each said anchoring member constructed and arranged to removably attach to said base member at said first end and secure to said support member at said second end without said track penetrating said outer surface, wherein said track is capable of being removed from said first end of said anchoring member while said second end remains secured to said support member.

3. The adjustable anchoring assembly of claim 2, wherein said anchoring member is secured to said track at selected positions there along, wherein said track is placed on top of freshly poured concrete with said anchoring members inserted into said poured concrete for precise positioning of said anchoring members to said track.

4. The adjustable anchoring assembly of claim 1, wherein the track is securable to a horizontal head rail of a stud wall having a plurality of vertical studs interconnected by the head rail.

5. The adjustable anchoring assembly of claim 4, wherein the track has a series of apertures there along for fastening the track to the head rail.

6. The adjustable anchoring assembly of claim 1, wherein the track is disposed upon the surface of a concrete filled upper region of a masonry wall such that the channel faces upward and out of the concrete.

7. The adjustable anchoring assembly as set forth in claim 1, further comprising a lateral clamping means defined by a flexible material having a first end integrally connected to said upper portion of said connector plate and a second end that frictionally engages said track to reduce motion along said lateral axis.

8. The adjustable anchoring assembly as set forth in claim 1, wherein said structural member is selected from the group consisting of said trusses, rafters, roof joists, floor joists, beams.

9. The adjustable anchoring assembly as set forth in claim 1, wherein one of said plurality of connector plates disposed within said track is releasably securable to at least one side of a structural member located substantially transverse to said longitudinal axis of said track, and another of said plurality of connector plates is releasably securable to the opposite side of said structural member, whereby multiple connector plates provide improved resistance to uplift forces.

10. The adjustable anchoring assembly as set forth in claim 2, further comprising at least one longitudinal clamping means defined by a rigid planar material constructed and arranged for placement over both said inwardly extending flange members, said longitudinal clamping means adapted to secure to said first end of said anchoring member when said second end is secured to said support member, wherein said longitudinal clamping means acts to further reinforce said track along said longitudinal axis.

11. A reusable centering bracket assembly for installing an elongated retaining a track assembly along an upper portion of a support member, said track having a base member integrally connected to a pair of oppositely spaced sidewall members extending from said base member defining a channel with an opening formed between said sidewalls, said bracket assembly comprising:

a support bracket having a first and second planar surface having at least one sidewall extending therebetween and width dimensions greater than that of said support member and at least one central aperture formed therethrough at approximately the center and at least one pair of corresponding centering pin holes formed therethrough located at equal distances on either side of said central aperture;

a fastening means having a first end and a second end, said first end including an integrally connected head portion having dimensions greater than said channel opening of said track and constructed and arranged to engage said sidewall members of said track, said second end constructed and arranged to extend through said central aperture to removably attach to said support bracket such that said track is in juxtaposed relation to said second planar surface; and at least two removable centering pins adapted for placement within corresponding said centering pin holes and having sufficient dimension to extend beyond said second planar surface such that upon insertion into said center pin holes that correspond to the width of said support member each centering pin is juxtaposed to the sides of said support member;

wherein upon placement of said bracket assembly over said upper portion of said support member said track is positioned at a substantially central location with respect to the width of said support member.

12. The reusable centering assembly as set forth in claim 11, wherein said second planar surface includes a centralized cutout portion constructed and arranged to substantially corresponding to said elongated retaining track to receive at least a portion of said track therein.

13. The reusable centering assembly as set forth in claim 11, wherein said track is sized to provide a moisture barrier between wood structural members and a masonry wall.

14. A method for attaching an elongated retaining track to an upper portion of a support member employing a reusable centering bracket assembly having a support bracket defined by a first and second planar surface having at least one sidewall extending therebetween with at least one central aperture formed therethrough, said central aperture located at approximately the center of said support bracket, and having at least one pair of corresponding centering pin holes located at equal distances on either side of said central aperture, said track having a base member integrally connected to a pair of oppositely spaced sidewall members extending from said base member, comprising the step of:

i) securing said track to the central portion of said centering bracket by a fastening means having a first and second end, said first end integrally attached to said sidewall members and said second end extending through said central aperture and removably attached to said support bracket such that said track is in juxtaposed relation to said second planar surface;

ii) inserting a plurality of centering pins within appropriate centering pin holes that correspond to the width of said support member;

iii) positioning said elongated retaining track on said support bracket;

iv) attaching said elongated track to said support bracket; and v) removing said support bracket from said elongated track;

wherein said track provides a bearing area for structural members.

15. A method for attaching an elongated retaining track to an outer surface of a masonry support member for attaching at least one structural member thereto, comprising the steps of:

forming a retaining track of essentially rectangular cross section having a longitudinal and lateral axis, a base member, and a pair of spaced apart sidewalls defining therebetween an outwardly facing channel with a restricted opening, said restricted opening defined by a pair of coplanar flanges, said base member having spaced apart apertures for receipt of said anchoring members securing thereto and extending outwardly from a lower surface of said base member;

securing said retaining track to said masonry support member by the steps of, attaching a plurality of anchors to said retaining track, inserted said anchors into said uncured poured concrete by positioning said retaining track on top of freshly poured concrete, wherein said anchors are embedded in said concrete and said track is removably secured to said anchors.

* * * * *